US007790342B2

(12) United States Patent
Abe et al.

(10) Patent No.: US 7,790,342 B2
(45) **Date of Patent: *Sep. 7, 2010**

(54) ELECTROPHOTOGRAPHIC PHOTOSENSITIVE BODY

(75) Inventors: Katsumi Abe, Koriyama (JP); Atsushi Takesue, Koriyama (JP); Takehiro Nakajima, Koriyama (JP); Makoto Koike, Koriyama (JP); Shinya Nagai, Koriyama (JP)

(73) Assignee: Hodogaya Chemical Co., Ltd., Kawasaki-shi (JP)

( * ) Notice: Subject to any disclaimer, the term of this patent is extended or adjusted under 35 U.S.C. 154(b) by 471 days.

This patent is subject to a terminal disclaimer.

(21) Appl. No.: 11/719,863

(22) PCT Filed: Nov. 21, 2005

(86) PCT No.: PCT/JP2005/021750

§ 371 (c)(1),
(2), (4) Date: May 22, 2007

(87) PCT Pub. No.: WO2006/054805

PCT Pub. Date: May 26, 2006

(65) Prior Publication Data

US 2009/0226830 A1 Sep. 10, 2009

(30) Foreign Application Priority Data

Nov. 22, 2004 (JP) ..... 2004-337169

(51) Int. Cl.
*G03G 5/06* (2006.01)

(52) U.S. Cl. ..... 430/58.05; 430/58.35; 430/58.65; 430/58.75; 430/66

(58) Field of Classification Search ..... 430/58.05, 430/58.35, 58.65, 58.75, 66
See application file for complete search history.

(56) References Cited

U.S. PATENT DOCUMENTS 4,708,922 A 11/1987 Yokoya et al.
4,830,944 A 5/1989 Umehara et al.
4,877,702 A * 10/1989 Miyamoto et al. ..... 430/72
5,213,924 A 5/1993 Sakamoto
5,395,715 A * 3/1995 Ueda et al. ..... 430/58.75

(Continued)

FOREIGN PATENT DOCUMENTS

EP 0 314 195 A2 5/1989

(Continued)

OTHER PUBLICATIONS

U.S. Appl. No. 11/720,078, filed May 24, 2007, Abe, et al.

(Continued)

*Primary Examiner*—Hoa V Le
(74) *Attorney, Agent, or Firm*—Oblon, Spivak, McClelland, Maier & Neustadt, L.L.P.

(57) ABSTRACT

An object of the present invention is to provide an electrophotographic photosensitive body having improved electrophotographic characteristics such as sensitivity and residual potential and also having excellent durability. The present invention provides an electrophotographic photosensitive body having a layer containing at least one specific p-terphenyl compound and at least one polycarbonate resin represented by the general formula (I):

in a mass ratio of the p-terphenyl compound to the polycarbonate resin within the range of 2:8 to 7:3.

19 Claims, 3 Drawing Sheets

U.S. PATENT DOCUMENTS

| | | | | |
|---|---|---|---|---|
| 5,567,560 | A * | 10/1996 | Hagiwara et al. | 430/58.85 |
| 5,604,063 | A * | 2/1997 | Endo et al. | 430/58.4 |
| 5,863,689 | A * | 1/1999 | Takei et al. | 430/83 |
| 7,041,419 | B2 * | 5/2006 | Tokutake et al. | 430/58.2 |
| 2003/0203298 | A1 | 10/2003 | Abe et al. | |
| 2004/0126685 | A1 | 7/2004 | Horgan et al. | |
| 2008/0044750 | A1 * | 2/2008 | Abe et al. | 430/69 |
| 2008/0076050 | A1 * | 3/2008 | Abe et al. | 430/58.35 |

FOREIGN PATENT DOCUMENTS

| | | |
|---|---|---|
| EP | 0 486 038 A1 | 5/1992 |
| GB | 2 187 296 | 9/1987 |
| JP | 62-112163 | 5/1987 |
| JP | 62-147462 | 7/1987 |
| JP | 1-118143 | 5/1989 |
| JP | 4-179961 | 6/1992 |
| JP | 2003-107761 | 4/2003 |

OTHER PUBLICATIONS

U.S. Appl. No. 11/597,657, filed Nov. 24, 2006, Abe, et al.

* cited by examiner

ELECTROPHOTOGRAPHIC PHOTOSENSITIVE BODY

TECHNICAL FIELD

The present invention relates to an electrophotographic photosensitive body. More particularly, it relates to an electrophotographic photosensitive body having good sensitivity and excellent durability.

BACKGROUND ART

Conventionally, inorganic photoconductive substances such as selenium, zinc oxide, cadmium sulfide and silicon have widely been used in an electrophotographic photosensitive body. Those inorganic substances had many advantages and simultaneously had various disadvantages. For example, selenium has the disadvantages that its production conditions are difficult and it is liable to crystallize by heat or mechanical shock. Zinc oxide and cadmium sulfide have problems in moisture resistance and mechanical strength, and have the disadvantage such that electrostatic charge and exposure deterioration take place by a coloring matter added as a sensitizer, thus lacking in durability. Silicon involves that its production conditions are difficult, cost is expensive because of using a gas having strong irritating properties and care should be taken to handling because of being sensitive to humidity. Additionally selenium and cadmium sulfide have the problem in toxicity.

Organic photosensitive bodies using various organic compounds that improved disadvantages of those inorganic photosensitive bodies are widely used. Organic photosensitive bodies include a single layer photosensitive body having a charge generating agent and a charge transport agent dispersed in a binder resin, and a multi-layered photosensitive body having a charge generating layer and a charge transport layer functionally separated. The characteristics of such a photosensitive body called a functional separation type are that a material suitable to the respective function can be selected from a wide range, and a photosensitive body having an optional function can easily be produced. From such a situation many investigations have been carried out.

As described above, to satisfy requirements such as basic performances required in electrophotographic photosensitive bodies and high durability, various improvements have been made in development of new materials, their combinations and the like, but it is the present situation that satisfactory photosensitive bodies are not yet obtained.

As one example of the above, it is generally known that when various photosensitive bodies are prepared by varying a binder resin to a specific charge transport agent, the kind of the binder resin affects film properties and electrophotographic characteristics of the photosensitive body. For example, when a photosensitive body is prepared using a polystyrene resin as a binder resin to a stilbene charge transport agent, electrophotographic characteristics represented by drift mobility and sensitivity are improved, but reversely the film becomes brittle and film properties deteriorate. Further, when a photosensitive body is prepared using an acrylic acid ester resin as a binder resin, electrophotographic characteristics deteriorate though film properties become good.

DISCLOSURE OF INVENTION

As a result of keen investigations on electrophotographic photosensitive bodies having high sensitivity and excellent durability, the present inventors have found that an electrophotographic photosensitive body containing a p-terphenyl compound and a polycarbonate resin has high sensitivity and excellent durability. An object of the present invention is to provide an electrophotographic photosensitive body having improved electrophotographic characteristics such as sensitivity and residual potential and further fulfilling excellent durability by combining a p-terphenyl compound and a polycarbonate resin.

The present invention relates to an electrophotographic photosensitive body comprising a conductive support having thereon a layer comprising at least one p-terphenyl compound selected from the following compounds (1) to (5)

(1)

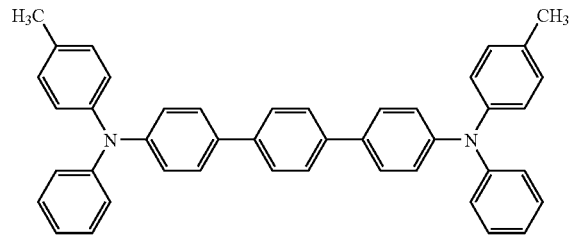

(2)

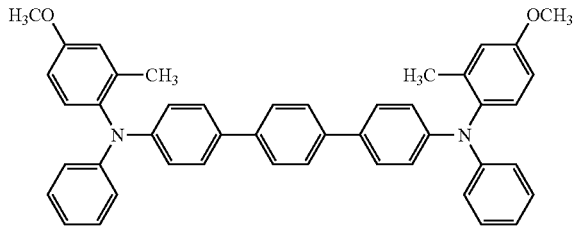

(3)

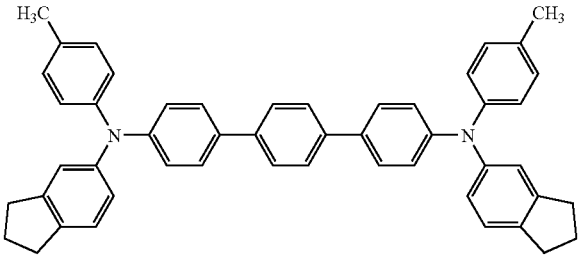

(4)

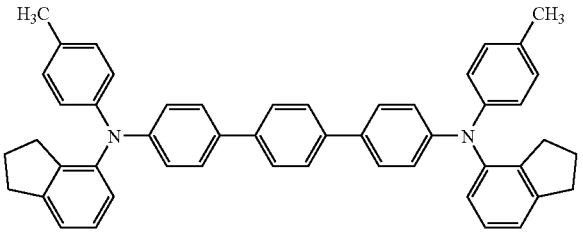

-continued (5)

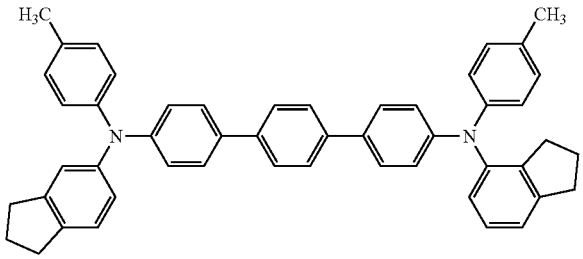

and at least one polycarbonate resin represented by the following general formula (I)

(I)

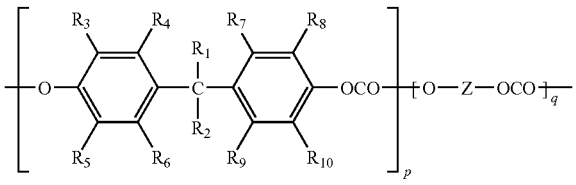

wherein $R_1$ and $R_2$ which may be the same or different represent a hydrogen atom, a substituted or unsubstituted alkyl group or a substituted or unsubstituted aryl group; $R_1$ and $R_2$ may be combined to form a ring; $R_3$, $R_4$, $R_5$, $R_6$, $R_7$, $R_8$, $R_9$ and $R_{10}$ which may be the same or different represent a hydrogen atom, a substituted or unsubstituted alkyl groups a substituted or unsubstituted aryl group or a halogen atoms p and o represent a molar compositional fraction (q includes zero); a ratio of p and a has a relationship satisfying the formula $0 \leqq q/p \leqq 2$; Z represents a substituted or unsubstituted alkylene group having from 1 to 5 carbon atoms, a substituted or unsubstituted 4,4'-biphenylene group or a divalent group represented by the following general formula (II)

(II)

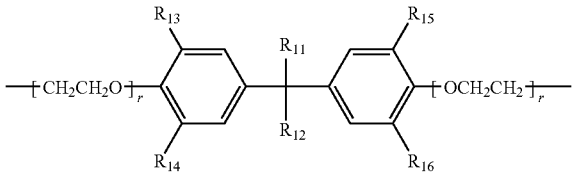

wherein $R_{11}$ and $R_{12}$ which may be the same or different represent a hydrogen atom, a substituted or unsubstituted alkyl group or a substituted or unsubstituted aryl group; $R_{11}$ and $R_{12}$ may be combined to form a ring; $R_{13}$, $R_{14}$, $R_{15}$ and $R_{16}$ which may be the same or different represent a hydrogen atom, a substituted or unsubstituted alkyl group, a substituted or unsubstituted aryl group or a halogen atom, and r is an integer of from 0 to 3, in a mass ratio of the p-terphenyl compound to the polycarbonate resin within the range of 2:8 to 7:3, with the proviso that when only one kind of the polycarbonate resin is used, the case where the polycarbonate resin represented by the general formula (I) has a structure that $R_1$ and $R_2$ are a methyl group, $R_3$, $R_4$, $R_5$, $R_6$, $R_7$, $R_8$, $R_9$ and $R_{10}$ are a hydrogen atom, and q is 0 is excluded.

By using the electrophotographic photosensitive body of the present invention, electrophotographic characteristics such as sensitivity and residual potential can be improved, and further, high durability can be satisfied.

Specific examples of the polycarbonate resin represented by the general formula (I) include resins represented by the following structural formulae, but the polycarbonate resin used in the present invention is not limited to those specific examples. However, the case where the polycarbonate resin represented by the general formula (I) consists only of the polycarbonate resin represented by the structural formula (6) is excluded.

(6)

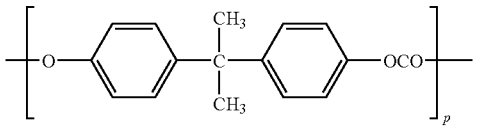

(7)

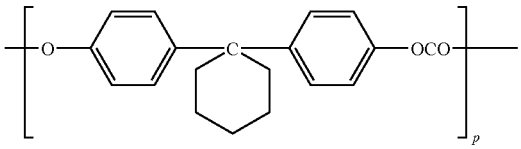

(8)

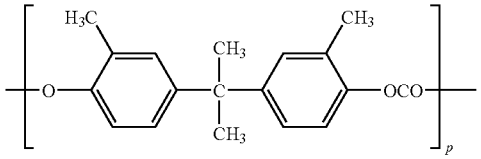

(9)

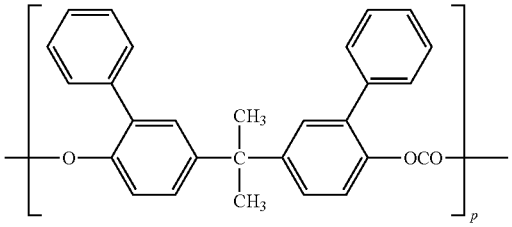

-continued
(10)
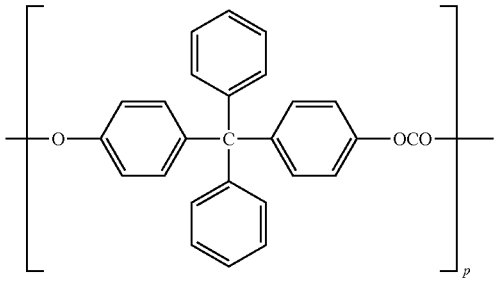
(11)
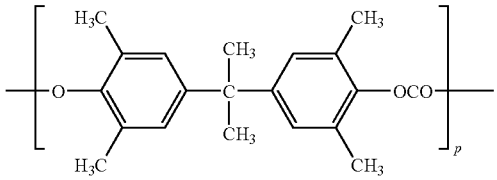
(12)
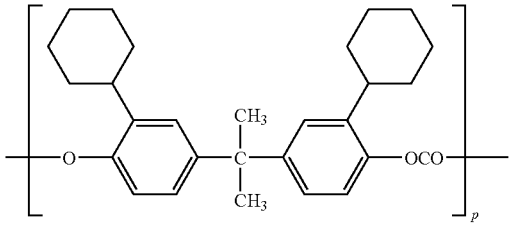
(13)
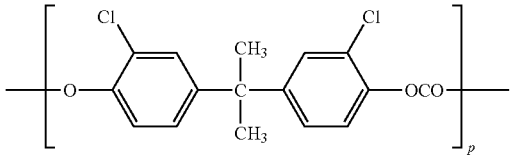
(14)
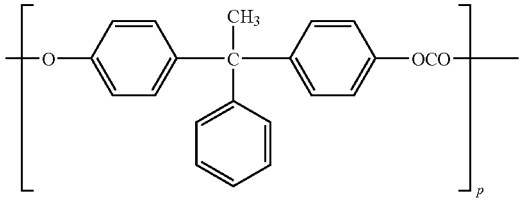
(15)
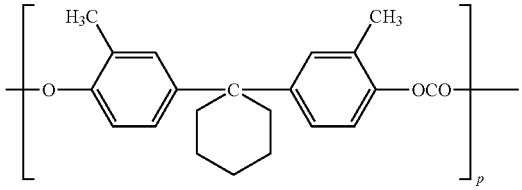
(16)
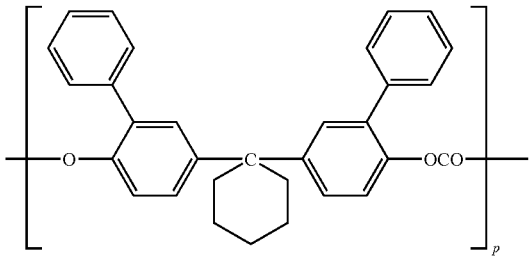
(17)
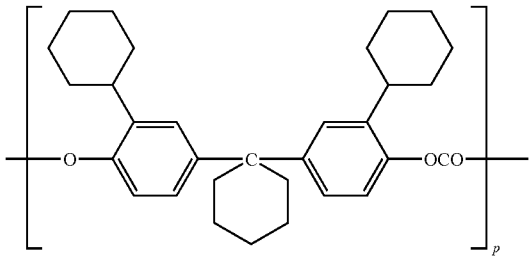
(18)
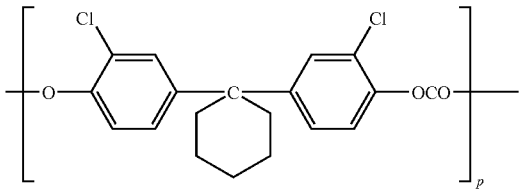
(19)
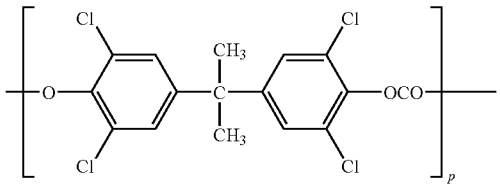
(20)
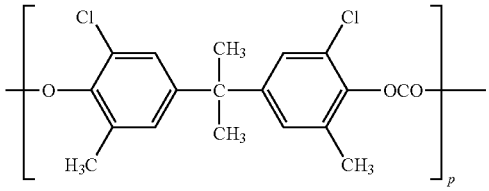
(21)
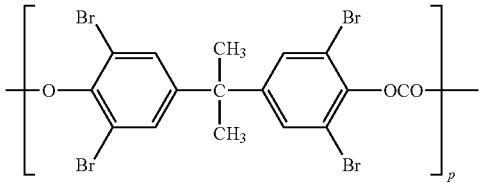
(22)
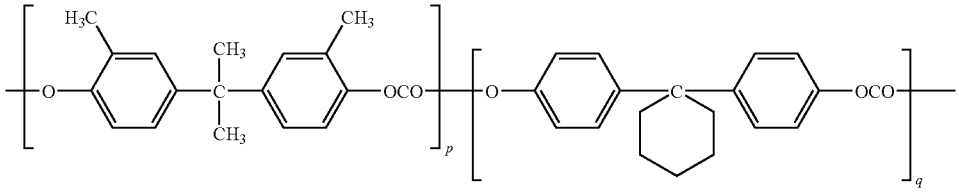

-continued (23)

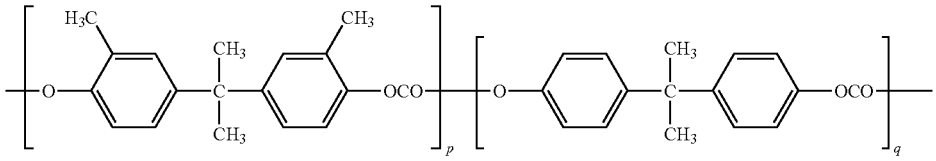

(24)

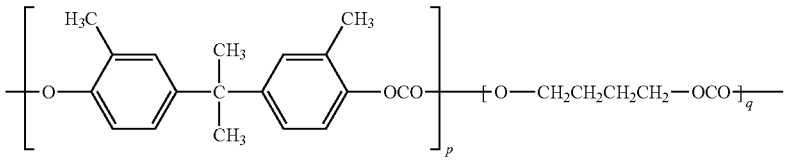

(25)

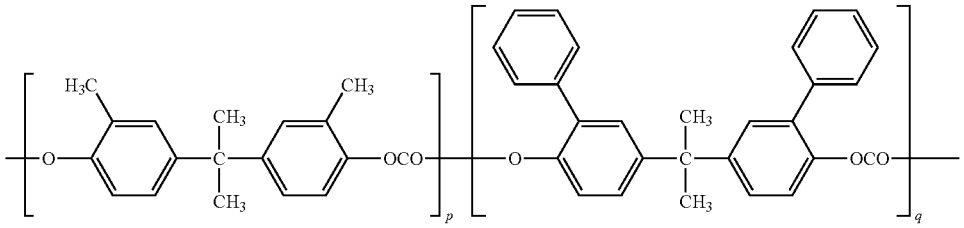

(26)

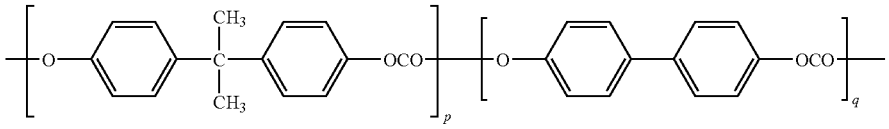

(27)

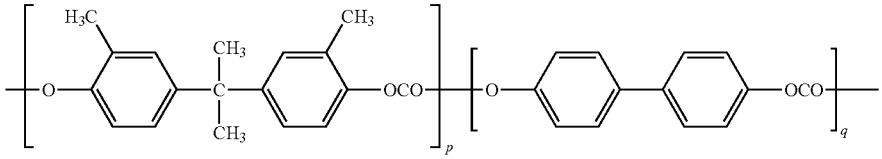

(28)

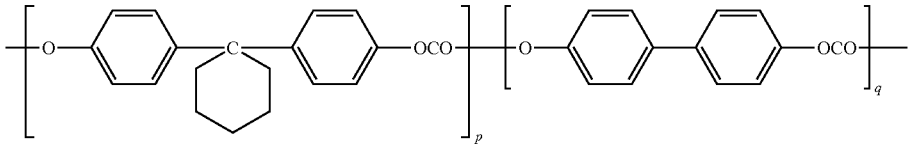

The electrophotographic photosensitive body of the present invention has a photosensitive layer containing at least one p-terphenyl compound selected from the compounds (1) to (5) and further containing at least one polycarbonate resin represented by the general formula (I) (with the proviso that the case of containing only the polycarbonate resin represented by the structural formula (6) is excluded).

According to the present invention, by using in combination the p-terphenyl compound having a specific structure as a charge transport agent and the polycarbonate resin having a specific structure as a binder resin, electrophotographic characteristics such as sensitivity and residual potential are improved, thereby providing an electrophotographic photosensitive body having additionally excellent durability.

Figure 1:
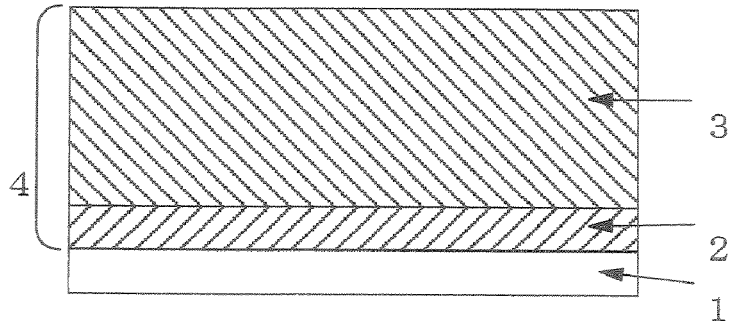
FIG. 1 is a schematic sectional view showing a layer structure of a functional separation type electrophotographic photosensitive body.

The reference numerals used in the drawings are as follows.

1: Conductive support
2: Charge generating layer
3: Charge transport layer
4: Photosensitive layer
5: Undercoat layer
6: Charge transport substance-containing layer
7: Charge generating substance
8: Protective layer

BEST MODE FOR CARRYING OUT THE INVENTION

Various embodiments of a photosensitive layer are present, and the photosensitive layer used in the electrophotographic photosensitive body of the present invention may be any of those. Such photosensitive bodies are shown in FIGS. 1 to 7 as the representative examples.

Figure 2:
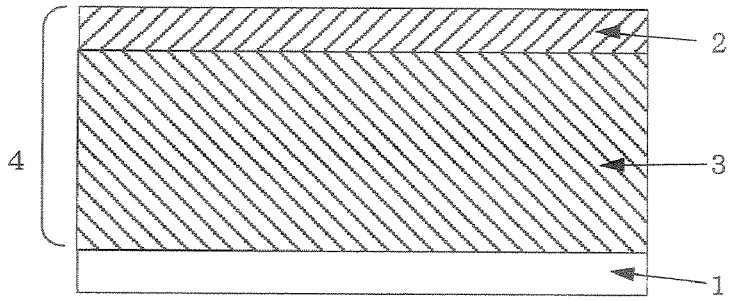
FIG. 2 is a schematic sectional view showing a layer structure of a functional separation type electrophotographic photosensitive body.
Figure 3:
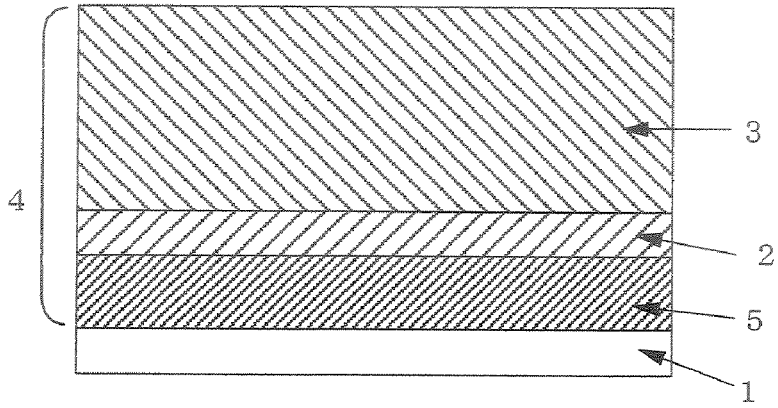
FIG. 3 is a schematic sectional view showing a layer structure of a functional separation type electrophotographic photosensitive body having an undercoat layer provided between a charge generating layer and a conductive support.
Figure 4:
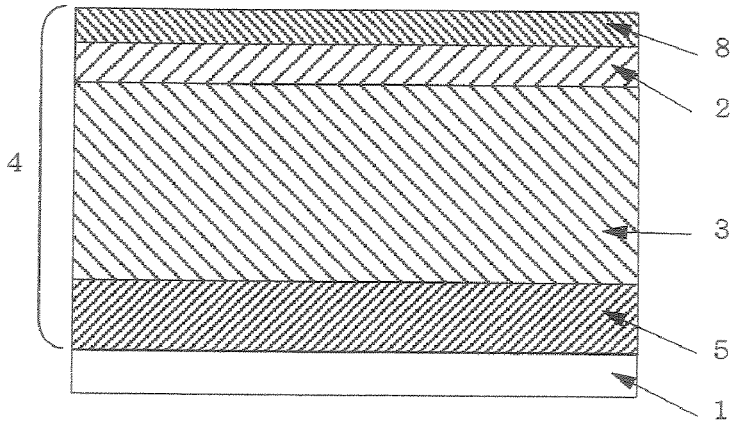
FIG. 4 is a schematic sectional view showing a layer structure of a functional separation type electrophotographic photosensitive body having an undercoat layer provided between a charge transport layer and a conductive support, and further having a protective layer provided on a charge generating layer.
Figure 5:
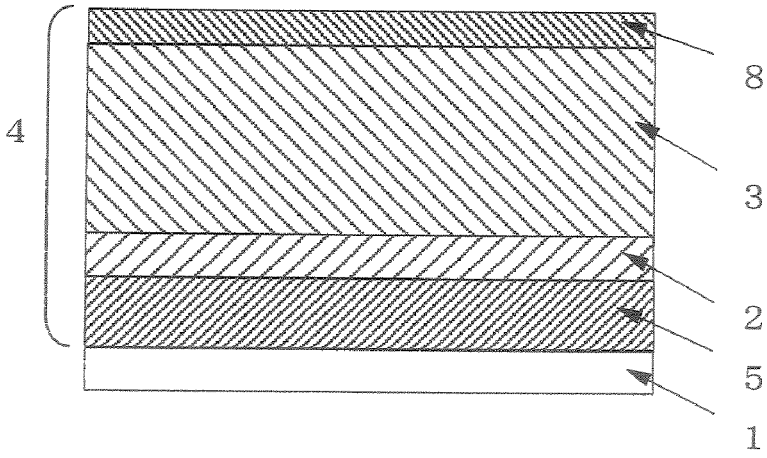
FIG. 5 is a schematic sectional view showing a layer structure of a functional separation type electrophotographic photosensitive body having an undercoat layer provided between a charge generating layer and a conductive support, and further having a protective layer provided on a charge transport layer.
Figure 6:
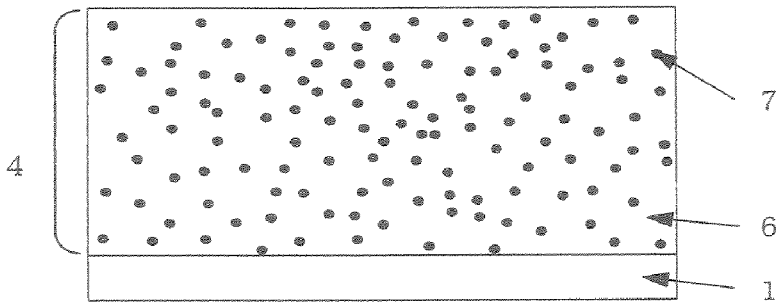
FIG. 6 is a schematic sectional view showing a layer structure of a single layer electrophotographic photosensitive body.
Figure 7:
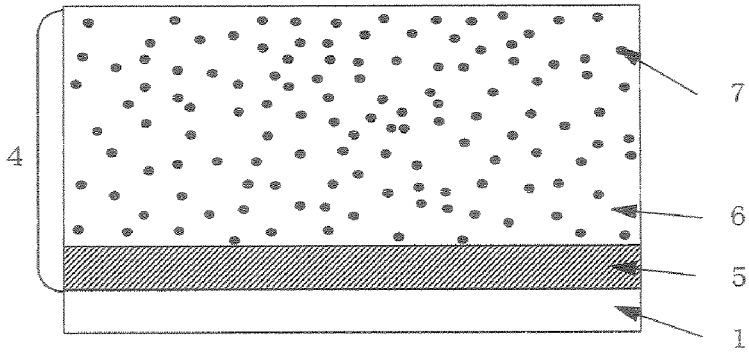
FIG. 7 is a schematic sectional view showing a layer structure of a single layer electrophotographic photosensitive body having an undercoat layer provided between a photosensitive layer and a conductive support.

FIGS. 1 and 2 shows a structure comprising a conductive support 1 having provided thereon a photosensitive layer 4 comprising a laminate of a charge generating layer 2 comprising a charge generating substance as a main component and a charge transport layer 3 comprising a charge transport substance and a binder resin as main components. In this embodiment, as shown in FIGS. 3, 4 and 5 the photosensitive layer 4 may be provided through an undercoat layer 5 for adjusting charges provided on the conductive support, and a protective layer 8 may be provided as an outermost layer. Further in the present invention, as shown in FIGS. 6 and 7 the photosensitive layer 4 comprising a charge generating substance 7 dissolved or dispersed in a layer 6 comprising a charge transport substance and a binder resin as main components may be provided on the conductive support 1 directly or through the undercoat layer 5.

The photosensitive body of the present invention can be prepared according to the conventional method as follows. For example, at least one p-terphenyl compound selected from the compounds (1) to (5) and at least one polycarbonate resin represented by the general formula (I) are dissolved in an appropriate solvent, and according to need, charge generating substances, electron withdrawing compounds, antioxidants ultraviolet absorbers, light stabilizers, plasticizers, pigments and other additives are added, thereby preparing a coating liquid. This coating liquid is applied to the conductive support and dried to form a photosensitive layer of from several μm to several tens μm. Thus, a photosensitive body can e produced. When the photosensitive layer comprises two layers of a charge generating layer and a charge transport layer, the photosensitive layer can be prepared as follow. At least one p-terphenyl compound selected from the compounds (1) to (5) and at least one polycarbonate resin represented by the general formula (I) are dissolved in an appropriate solvent, and ant-oxidants, ultraviolet absorbers light stabilizers plasticizers, pigments and other additives are added thereto, thereby preparing a coating liquid, and the coating liquid thus prepared is applied to the charge generating layer, or a charge transport layer is obtained by applying the coating liquid, and a charge generating layer is then formed on the charge transport layer. According to need, the photosensitive body thus prepared may be provided with an undercoat layer and a protective layer.

The p-terphenyl compound of the compounds (1) to (5) can be synthesized bye for example, condensation reaction such as Ullmann reaction of 4,4"-diiodo-p-terphenyl or 4,4"-dibromo-p-terphenyl and the corresponding amino compound. The corresponding amino compound can be synthesized by, for example, condensation reaction such as Ullmann reaction of aminoindane and p-iodotoluene or p-bromotoluene, and condensation reaction such as Ullmann reaction of the corresponding aniline derivatives and the corresponding iodobenzene derivatives or the corresponding bromobenzene derivatives. The aminoindane can be synthesized by, for example, amination (for example, see Non-Patent Document 2) after passing halogenation (for example, see Non-Patent Document 1) of indane.

Non-Patent Document 1*: Jikken Kagaku Koza* (4th edition, the Chemical Society of Japan) vol. 19, pages 363 to 482

Non-Patent Document 2*: Jikken Kagaku Koza* (4th edition, the Chemical Society of Japan) vol. 20, pages 279 to 318

A mass ratio of the p-terphenyl compound and the polycarbonate resin used in the photosensitive body of the present invention is from 2:8 to 7:3. The preferable use amount is the case that the mass ratio of the p-terphenyl compound and the polycarbonate resin is from 3:7 to 6:4.

The conductive support on which the photosensitive layer of the present invention is formed can use the materials used in the conventional electrophotographic photosensitive bodies. Examples of the conductive support that can be used include metal drums or sheets of aluminum, aluminum alloy, stainless steel, copper, zinc, vanadium, molybdenum, chromium, titanium, nickel, indium, gold, platinum or the like; laminates or depositions of those metals; plastic films, plastic drums, papers or paper cores, obtained by applying conductive substances such as metal powder, carbon black, copper iodide and polymer electrolyte thereto together with an appropriate binder to conduct conducting treatment; and plastic films or plastic drums, obtained by containing conductive substances therein to impart conductivity.

Further, according to need, an undercoat layer comprising a resin, or a resin and a pigment may be provided between the conductive support and the photosensitive layer. The pigment dispersed in the undercoat layer may be a powder generally used, but is desirably a while pigment that does not substantially absorb near infrared light or the similar pigment when high sensitization is considered Examples of such a pigment include metal oxides represented by titanium oxide, zinc oxide, tin oxide, indium oxide, zirconium oxide, alumina and silica. The metal oxides that do not have hygroscopic properties and have less environmental change are desirable.

Further, as a resin used in the undercoat layer, resins having high solvent resistance to general organic solvents are desirable, considering that a photosensitive layer is applied to the undercoat layer, using a solvent Examples of such a resin include water-soluble resins such as polyvinyl alcohol, casein and sodium polyacrylate; alcohol-soluble resins such as copolymer nylon and methoxymethylated nylon; and curing resins that form a three-dimensional network structure such as polyurethane, melamine resin and epoxy resin.

The charge generating layer in the present invention comprises a charge generating agent, a binder resin, and additives added according to need, and its production method includes a coating method, a deposition method and a CVD method.

Examples of the charge generating agent include phthalocyanine pigments such as various crystal titanyl phthalocyanines, titanyl phthalocyanine having strong peaks of a diffraction angle $2\theta \pm 0.2°$ in X-ray diffraction spectrum of Cu—Kα at 9.3, 10.6, 13.2, 15.1, 20.8, 23.3 and 26.3, titanyl phthalocyanine having strong peaks of a diffraction angle 2θ±0.2° at 7.5, 10.3, 12.6, 22.5, 24.3, 25.4 and 28.6, titanyl phthalocyanine having strong peaks of a diffraction angle 2θ±0.2° at 9.6, 24.1 and 27.2, various crystal metal-free phthalocyanine such as τ type and X type, copper phthalocyanine, aluminum phthalocyanine, zinc phthalocyanine, α type, β type and Y type oxotitanyl phthalocyanines, cobalt phthalocyanine, hydroxygallium phtalocyanine, chloroaluminum phthalocyanine, and chloroindium phthalocyanine; azo pigments such as azo pigment having triphenylamine skeleton (for example, see Patent Document 1), azo pigment having carbazole skeleton for example, see Patent Document 2), azo pigment having fluorene skeleton (for example, see Patent Document 3), azo pigment having oxadiazole skeleton (for example, see Patent Document 4), azo pigment having bisstylbene skeleton (for example, see Patent Document 5), azo pigment having dibenzothiophene skeleton (for example, see Patent Document 6), azo pigment having distyrylbenzene skeleton (for example, see Patent Document 7), azo pigment having distyrylcarbazole skeleton (for example, see Patent Document 8), azo pigment having distyryloxadiazole skeleton (for example, see Patent Document 9), azo pigment having stylbene skeleton (for example, see Patent Document 10), trisazo pigment having carbazole skeleton (for example, see Patent Documents 11 and 12), azo pigment having anthraquinone skeleton (for example, see Patent Document 13), and bisazo pigment having diphenylpolyene skeleton (for example, see Patent Document 14 to 18); perylene pigments such as peryleic anhydride and peryleic imide; polycyclic quinine pigments such as anthraquinone derivative, anthanthrone derivative, dibenzpyrenequinone derivative, pyranthrone derivative, violanthrone derivative and iso-violanthrone; d-phenylmethane and triphenylmethane pigments; cyanine an azomethine pigments; indigo pigments; bisbenzimidazole pigments; azulenium salts; pyrylium salts; thiapyrylium salts; benzopyrylium salts; and squarylium salts. Those may be used alone or as mixtures of two or more thereof according to need.

Patent Document 1: JP-A-53-132347
Patent Document 2: JP-A-53-95033
Patent Document 3: JP-A-54-22834
Patent Document 4: JP-A-54-12742
Patent Document 5: JP-A-54-17733
Patent Document 6: JP-A-54-21728
Patent Document 7: JP-A-53-133445
Patent Document 8: JP-A-54-17734
Patent Document 9: JP-A-54-2129
Patent Document 10: JP-A-53-138229
Patent Document 11: JP-A-57-195767
Patent Document 12: JP-A-57-195768
Patent Document 13: JP-A-57-202545
Patent Document 14: JP-A-59-129857
Patent Document 15: JP-A-62-267363
Patent Document 16: JP-A-64-79753
Patent Document 17: JP-B-3-34503
Patent Document 18: JP-B-4-52459

The binder resin is not particularly limited, and examples thereof include polycarbonate, polyarylate polyester, polyamide, polyethylene, polystyrene, polyacrylate, polymethacrylate, polyvinyl butyral, polyvinyl acetal, polyvinyl formal, polyvinyl alcohol, polyacrylonitrile, polyacrylamide, styrene-acryl copolymer, styrene-maleic anhydride copolymer, acrylonitrile-butadiene copolymer polysulfone, polyether sulfone, silicon resin and phenoxy resin. Those may be used alone or as mixtures of two or more thereof according to need.

The additives used according to need include antioxidants, ultraviolet absorbers, light stabilizers, dispersing agents, binders, and sensitizers. The charge generating layer prepared using the above materials has a film thickness of from 0.1 to 2.0 μm, and preferably from 0.1 to 1.0 μm. The charge transport layer in the present invention can be formed by dissolving a charge transport agent, a binder resin and according to need, an electron accepting substance and additives in a solvent, applying the resulting solution to the charge generating layer, the conductive support or the undercoat layer, and drying.

The solvent used is not particularly limited so long as it dissolves a charge transport agent, a binder resin, an electron accepting substance and additives. Examples of the solvent that can be used include polar organic solvents such as tetrahydrofuran, 1,4-dioxane, methyl ethyl ketone, cyclohexanone, aceronitrile, N,N-dimethylformamide and ethyl acetate; aromatic organic solvents such as toluene, xylene and chlorobenzene; and chlorine-based hydrocarbon solvents such as chloroform, trichloroethylene, dichloromethane and 1,2-dichloroethane. Those may be used alone or as mixtures of two or more thereof according to need.

The photosensitive layer of the present invention can contain an electron accepting substance for the purpose of improvement of sensitivity, decrease of residual potential or reduction of fatigue when used repeatedly Examples of the electron accepting substance include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodiethane, o-dinitrobenzene, m-dinitrobenzene, 1,3,5-trinitrobenzene, p-nitrobenzonitrile, picryl chloride, quinonechloroimide, chlorarnil, bromanil, dichlorodicyano-p-benzoquinone, anthraquinone, dinitroanthraquinone, 2,3-dichloro-1,4-naphthoquinone, 1-nitroanthraquinone, 2-chloroanthraquinone, phenanthrenequinone, terephthalal malenonitrile, 9-anthrylmethylidene malenonitrile, 9-fluoronylidene malononitrile, polynitro-9-fluoronylidene malononitrile, 4-nitrobenzaldehyde, 9-benzoylanthracene, indanedione, 3,5-dinitrobenzophenone, 4-chloronaphthalic anhydride, 3-benzalphthalide, 3-(α-cyano-p-nitrobenzal)-4,5,67-tetrachlorophthalide, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and other compounds having large electron affinity.

Examples of the additive used according to need include antioxidants, ultraviolet absorbers, light stabilizers, plasticizers, quenching agents, dispersing agents and lubricants. Examples of the antioxidant include monophenol compounds such as 2,6-di-tert-butyl-p-cresol, 2,6-di-tert-butyl-p-methoxyphenol, 2-tert-butyl-4-methoxyphenol, 2,4-dimethyl-6-tert-butylphenol, butylated hydroxyanisole, stearyl-β-(3,5-di-tert-butyl-4-hydroxyphenyl)propionate, α-tocopherol, β-tocopherol, 2,4-bis-(n-octylthio)-6-(4-hydroxy-3,5-di-tert-butylanilino)-1,3,5-triazine, octadecyl-3-(3,5-di-tert-butyl-4-hydroxyphenyl)proplonate, 3,5-di-tert-butyl-4-hydroxy-benzylphosphonate-diethyl ester, 2,4-bis[(octylthio) methyl]-o-cresol and isooctyl-3-(3,5-di-tert-butyl-4-hydroxyphenyl)propionate; and polyphenol compounds such as triethyleneglycol-bis[3-(3-tert-butyl-5-methyl-4-hydroxyphenyl)propionate], 1,6-hexanediol-bis[3-(3,5-di-tert-butyl-4-hydroxyphenyl)-propionate], pentaerythrityl-tetrakis[3-(3,5-di-tert-butyl-4-hydroxyphenyl)propionate], 2,2-thiodiethylenebis[3-(3,5-di-tert-butyl-4-hydroxyphenyl) propionate], N,N'-hexamethylenebis(3,5-di-tert-butyl-4-hydroxyhydrocinnmamide), 1,3,5-trimethyl-2,4,6-tris(3-5-di-tert-butyl-4-hydroxybenzyl)benzene, tris(3,5-di-tert-butyl-4-hydroxybenzyl)-isocyanurate, 2,2-thiobis(4-methyl-6-tert-butylphenol), 2,2'-methylenebis(6-tert-butyl-4-methylphenol), 4,4'-butylidene-bis-(3-methyl-6-tert-butylphenol), 4,4'-bis(6-tert-butyl-3-methylphenol) and 1,1,3-tris(2-methyl-4-hydroxy-5-tert-butylphenyl)butane. Those monophenol compounds and polyphenol compounds may be used alone or as mixtures of two or more thereof. Further, those compounds may be used by mixing with ultraviolet absorbers or light stabilizers.

Examples of the ultraviolet absorber include benzotriazole compounds such as 2-(5-methyl-2-hydroxyphenyl)benzotriazole, 2-[2-hydroxy-3,5-bis(α,α-dimethylbenzyl)phenyl]-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole, 2-(2-hydroxy-5-tert-octylphenyl)benzotriazole and 2-[2-hydroxy-3-(3,4,5,6-tetrahydrophthalimide-methyl)-5-methylphenyl]; and benzophenone compounds such as 2-hydroxy-4-methoxybenzophenone, 2-hydroxy-4-n-octoxybenzophenone, 2,2',4,4'-tetrahydroxybenzophenone, 2,4-dihydroxybenzophenone, 2,2'-dihydroxy-4,4'-dimethoxybenzophenone, 2,2'-dihydroxy-4-methoxybenzophenone, 2-hydroxy-4-octadecyloxybenzophenone and 4-dodecyloxy-2-hydroxybenzophenone. Additionally, regarding benzoate compounds, cyanoacrylate compounds, oxalic anilide compounds, triazine compounds and the like, commercially available compounds are suitably used. Those ultraviolet absorbers may be used alone or as mixtures of two or more thereof. Further, those compounds may be used by mixing with light stabilizers or antioxidants.

Examples of the light stabilizer include hindered amine compounds such as dimethyl succinate.1-(2-hydroxyethyl)-4-hydroxy-2,2,6,6-tetramethylpiperidine polycondensate, poly{[6-(1,1,3,3-tetramethylbutyl)amino-1,3,5-triazine-2,4-diyl][(2,2,6,6-tetramethyl-4-piperidyl)imino]hexa-methylene[(2,2,6,6-tetramethyl-4-piperidyl)imino]}, N,N'-bis(3-aminopropyl)ethylenediamine-2,4-bis[N-butyl-N-(1,2,2,6,6-pentamethyl-4-piperidyl)amino]-6-chloro-1,3,5-triazine condensate, bis(2,2,6,6-tetramethyl-4-piperidyl)sebacate, bis(1,2,6,6-pentamethyl-4-piperidinyl)sebacate and 2-(3,5-di-tert-butyl-4-hydroxybenzyl)-2-n-butyl malonic acid bis(1,2,2,6,6-pentamethyl-4-pierpidine). Those light stabilizers may be used alone or as mixtures of two or more thereof. Further, those compounds may be used by mixing with ultraviolet absorbers or antioxidants.

As the additives, a compound having both a function of an antioxidant and a function of an ultraviolet absorber in one molecule may be added. Specific examples of the additive include benzotriazole-alkyllenebisphenol compounds such as 6-(2-benzotriazolyl)-4-tert-butyl-6'-tert-butyl-4'-methyl-2,2'-methylenebisphenol, 6-(2-benzotriazolyl)-4-tert-butyl-4',6'-di-tert-butyl-2,2'-methylenebisphenol, 6-(2-benzotriazolyl)-4-tert-butyl-4',6'-di-tert-amyl-2,2'-methylenebisphenol, 6-(2-benzotriazolyl)-4-tert-butyl-4',6'-di-tert-octyl-2,2'-methylenebisphenol, 6-(2-benzotriazolyl)-4-tert-octyl-6'-tert-butyl-4'-methyl-2,2'-methylenebisphenol, 6-(2-benzotriazolyl)-4-tert-octyl-4',6'-di-tert-butyl-2,2'-methylenebisphenol, 6-(2-benzotriazolyl)-4-tert-octyl-4',6'-di-tert-amyl-2,2'-methylenebisphenol, 6-(2-benzotriazolyl)-4-tert-octyl-4',6'-di-tert-octyl-2,2'-methylenebisphenol, 6-(2-benzotriazolyl)-4-tert-methyl-6'-tert-butyl-4'-methyl-2,2'-methylenebisphenol, 6-(2-benzotriazolyl)-4-methyl-4',6'-di-tert-butyl-2,2'-methylenebisphenol, 6-(2-benzotriazolyl)-4-methyl-4',6'-di-tert-amyl-2,2'-methylenebisphenol and 6-(2-benzotriazolyl)-4-methyl-4',6'-di-tert-octyl-2,2'-methylenebisphenol. Those compounds may be used alone or as mixtures of two or more thereof. Further, those compounds may be used by mixing with ultraviolet absorbers or antioxidants.

The photosensitive layer of the present invention may contain the conventional plasticizers for the purpose of improving film-forming properties flexibility and mechanical strength. Examples of the plasticizer that can be used include phthalic ester, phosphoric ester, chlorinated paraffin, methylnaphthalene, epoxy compound and chlorinated fatty acid ester.

According to need, a surface protective layer may be provided on the surface of the photosensitive body. Materials that can be used for the protective layer include resins such as polyester and polyamide, and mixtures of those resins and metals metal oxides, and the like that can control electric resistance. The surface protective layer is desirable to be transparent as much as possible in a wavelength region of light absorption of the charge generating agent.

The present invention will be illustrated in greater detail with reference to the following Examples but the invention should not construed as being limited to those Examples. In the Examples "part" means "part by mass", and "%" means "% by weight".

Example 1

Synthesis Example 1

Synthesis of Compound (1)

11.5 g (0.063 mol) of phenyl-p-tolylamine, 14.5 g (0.030 mol) of 4,4"-diiodo-p-terphenyl, 5.0 g (0.036 mol) of anhydrous potassium carbonate, 0.38 g (0.006 mol) of a copper powder and 15 ml of n-dodecane were mixed, and while introducing a nitrogen gas, the resulting mixture was heated to 200 to 210° C. and stirred for 30 hours. After completion of the reaction, the reaction product was extracted with 400 ml of toluene, insoluble contents were removed by filtration, and the filtrate was concentrated to dryness. The solid obtained was purified with column chromatography (carrier: silica gel, elute: toluene:hexane=1:4) to obtain 13.6 g of N-N'-diphenyl-N,N'-di-p-tolyl-4,4"-diamino-p-terphenyl (compound (1)) (yield: 76.4%, melting point: 167.2 to 168.2° C.).

It was identified as compound (1) by elementary analysis and IR measurement. Elementary analysis values are as follows. Carbon: 89.23% (89.15%) hydrogen: 6.14% (6.12%), and nitrogen: 4.60% (4.73%) (calculated values are shown in the parenthesis).

Example 2

Synthesis Example 2

Synthesis of Compound (2)

14.1 g (0.066 mol) of (4-methoxy-2-methylphenyl)phenylamine, 14.5 g (0.030 mol) of 4,4"-diiodo-p-terphenyl, 5.0 g (0.036 mol) of anhydrous potassium carbonate, 0.38 g (0.006 mol) of a copper powder and 15 ml of n-dodecane were mixed and while introducing a nitrogen gas, the resulting mixture was heated to 200 to 210° C. and stirred for 30 hours. After completion of the reaction, the reaction product was extracted with 400 ml of toluene, insoluble contents were removed by filtration and the filtrate was concentrated to dryness. The solid obtained was purified with column chromatography (carrier: silica gel, elute: toluene:hexane=1:2) to obtain 15.7 g of N-N'-di-(4-methoxy-2-methylphenyl)-N,N-diphenyl-4,4"-diamino-p-terphenyl (compound (2)) (yield: 80.0%, melting point: 180.8 to 183.4° C.).

It was identified as compound (2) by elementary analysis and IR measurement. Elementary analysis values are as follows. Carbon: 84.67% (84.63%), hydrogen: 6.23% (6.18%), and nitrogen: 4.26% (4.29%) (calculated values are shown in the parenthesis).

Example 3

Synthesis Example 3

Synthesis of Compound (3)

33.3 g (0.25 mol) of 5-aminoindane (a product of Tokyo Chemical Industry Co. Ltd.) was dissolved in 250 ml of glacial acetic acid, the resulting solution was heated to 50° C., and 51.0 g (0.5 mol) of acetic anhydride was added dropwise thereto. After completion of the dropwise addition, the resulting solution was stirred for 4 hours. After completion of the reaction, the reaction liquid was poured in 1,500 ml of ice water while stirring. Crystals precipitated were filtered off, and washed with 1,000 ml of water. The crystals obtained were dried to obtain 37.06 g of 5-(N-acetylamino)indane (yield: 84.6%, melting point: 100.5 to 103.5° C.)

26.28 g (0.15 mol) of 5-(N-acetylamino)indane, 43.61 g (0.20 mol) of p-iodotoluene, 25.88 g (0.188 mol) of anhydrous potassium carbonate and 2.38 g (0.038 mol) of a copper powder were mixed and while introducing a nitrogen gas, the resulting mixture was heated to 20° C. and stirred for 6 hours. After completion of the reaction, 22.3 g of potassium hydroxide dissolved in 20 ml of water and 50 ml of isoamyl alcohol were added to conduct hydrolysis at 130° C. for 2 hours. After completion of the hydrolysis, 250 ml of water was added, and Isoamyl alcohol was removed by azeotropic distillation. 200 ml of toluene was added to dissolve the reaction product. After filtration, the reaction product was dehydrated with magnesium sulfate. After filtering out the magnesium sulfate, the filtrate was concentrated, and purified with column chromatography (carrier: silica gel, elute: toluene:hexane=1:4) to obtain 32.3 of indan-5-yl-p-tolylamine.

18.1 g (0.081 mol) of indan-5-yl-p-tolylamine, 18.9 g (0.039 mol) of 4,4"-diiodo-p-terphenyl, 7.2 g (0.052 mol) of anhydrous potassium carbonate, 0.76 g (0.012 mol) of a copper powder and 30 ml of n-dodecane were mixed, and while introducing a nitrogen gas, the resulting mixture was heated to 200 to 210° C. and stirred for 30 hours. After completion of the reaction, the reaction product was extracted with 400 ml of toluene, insoluble contents were removed by filtration, and the filtrate was concentrated to dryness. The solid obtained was purified with column chromatography (carrier: silica gel, elute: toluene:hexane=1:4) to obtain 19.9 g of N-N'-bisinndan-5-yl-N,N'-di-p-tolyl-4,4"-diamino-p-terphenyl (compound (3)) (yield: 75.7%, melting point: 207.4 to 208.1° C.)

It was identified as compound (3) by elementary analysis and IR measurement. Elementary analysis values are as follows. Carbon: 89.13% (89.25%), hydrogen: 6.63% (6.59%), and nitrogen: 4.24% (4.16%) (calculated values are shown in the parenthesis).

Example 4

Photosensitive Body Example 1

1 part of alcohol-soluble polyamide (AMILAN CM-400, a product of Toray Industries, Inc.) was dissolved in 13 parts of methanol. 5 parts of titanium oxide (TIPAQUE CR-EL, a product of Ishihara Sangyo Kaisha, Ltd.) was added to the solution. The titanium oxide was dispersed with a paint shaker for 8 hours to prepare a coating liquid or an undercoat layer. The coating liquid was applied to an aluminum surface of an aluminum-deposited PET film using a wire bar to form an undercoat layer having a thickness of 1 μm.

1.5 parts of the following titanyl phthalocyanine (charge generating agent No. 1) having strong peaks of a diffraction angle 2θ±0.2 in X-ray diffraction spectrum of Cu—Kα at 9.6, 24.1 and 27.2

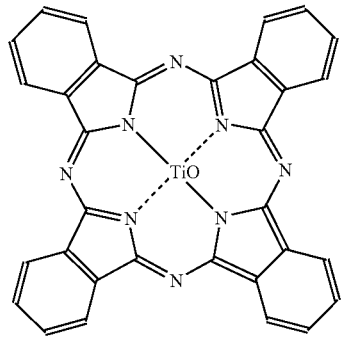

was added to 50 parts of a 3% cyclohexanone solution of a polyvinyl butyral resin (S-LEC BL-S, a product of Sekisui Chemical Co., Ltd.), and dispersed with an ultrasonic dispersing machine for 1 hour. The dispersion obtained was applied to the undercoat layer using a wire bar, and dried at 110° C. under atmospheric pressure our 1 hour to form a charge generating layer having a thickness of 0.6 μm.

On the other hand, 100 parts of the p-terphenyl compound of compound (3) as a charge transport agent (charge transport agent No. 3) was added to 962 parts of a 13.0% tetrahydrofuran solution of the flowing polycarbonate resin (polycarbonate resin No. 1):

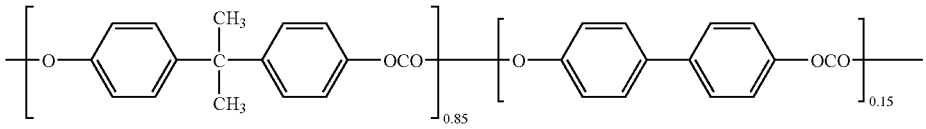

and the p-terphenyl compound was completely dissolved by applying ultrasonic wave. This solution was applied to the charge generating layer obtained above with a wire bar, and dried at 110° under atmospheric pressure for 30 minutes to form a charge transport layer having a thickness of 20 μm. Thus, a photosensitive body was prepared.

Example 5

Photosensitive Body Example 2

A photosensitive body was prepared in the same manner as in Example 4, except for using the following polycarbonate resin (polycarbonate resin No. 2) in place of the polycarbonate resin No. 1.

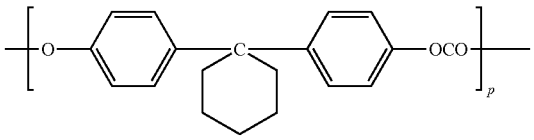

Example 6

Photosensitive Body Example 3

A photosensitive body was prepared in the same manner as in Example 4, except for using titanyl phthalocyanine having strong peaks of a diffraction angle 2θ±0.2° in X-ray diffraction spectrum of Cu—Kα at 7.5, 10.3, 12.6, 22.5, 24.3, 25.4 and 28.6 (charge generating agent No. 2) in place of the charge generating agent No. 1 and using the p-terphenyl compound of the compound (2) (charge transport agent No. 2) in place of the charge transport agent No. 3.

Example 7

Photosensitive Body Example 4

A photosensitive body was prepared in the same manner as in Example 6, except for using the polycarbonate resin No 2 in place of the polycarbonate resin No. 1.

Example 8

Photosensitive Body Example 5

A photosensitive body was prepared in the same manner as in Example 4, except for using titanyl phthalocyanine having strong peaks of a diffraction angle 2θ±0.2° in X-ray diffraction spectrum of Cu—Kα at 9.3, 10.6, 13.2, 15.1, 20.8, 23.3 and 26.3 (charge generating agent No. 3) in place of the charge generating agent No. 1 and using the p-terphenyl compound of the compound (1) (charge transport agent No. 1) in place of the charge transport agent No 2.

Example 9

Photosensitive Body Example 6

A photosensitive body was prepared in the same manner as in Example 8, except for using the polycarbonate resin No. 2 in place of the polycarbonate resin No. 1.

Example 10

Photosensitive Body Example 7

10 parts of alcohol-soluble polyamide (AMILAN CM-8000, a product of Toray Industries, Inc.) was dissolved in 190 parts of methanol. The resulting solution was applied to an aluminum surface of an aluminum-deposited PET film using a wire bar, and dried to form an undercoat layer having a thickness of 1 μm.

1.5 parts of the following τ-type metal-free phthalocyanine (charge generating agent No. 4) as a charge generating agent

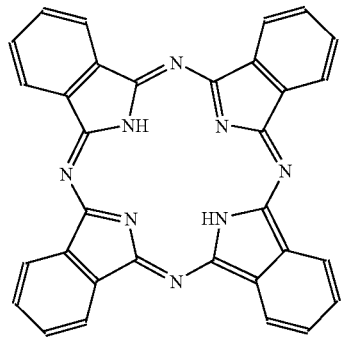

was added to 50 parts of a 3% cyclohexanone solution of a polyvinyl butyral resin (S-LEC BL-S, a product of Sekisui Chemical Co., Ltd.), and dispersed with an ultrasonic dispersing machine for 1 hour. The dispersion obtained was applied to the undercoat layer obtained above using a wire bar, and dried at 110° C. under atmospheric pressure for 1 hour to form a charge generating layer having a thickness of 0.6 μm.

On the other hand, 100 parts of the charge transport agent No. 1 as a charge transport agent was added to 962 parts of a 13.0% tetrahydrofuran solution of the polycarbonate resin No. 1, and the p-terphenyl compound was completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared.

Example 11

Photosensitive Body Example 8

A photosensitive body was prepared in the same manner as in Example 10 except for using the polycarbonate resin No. 2 in place of the polycarbonate resin No. 1.

Example 12

Photosensitive Body Example 9

A photosensitive body was prepared in the same manner as in Example 6, except for using the charge transport agent No. 1 in place of the charge transport agent No. 2.

Example 13

Photosensitive Body Example 10

A photosensitive body was prepared in the same manner as in Example 12, except for using a mixture of the polycarbonate resin No. 2 and the following polycarbonate resin (polycarbonate resin No. 3) in a mass ratio of 8:2 in place of the polycarbonate resin No. 1.

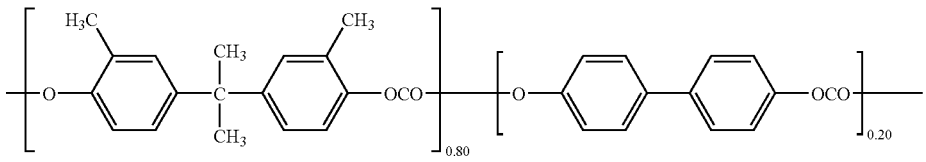

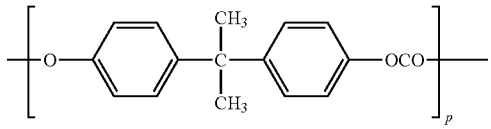

Example 14

Photosensitive Body Example 11

A photosensitive body was prepared in the same manner as in Example 4, except for using the following polycarbonate resin (polycarbonate resin No. 4) in place of the polycarbonate resin No. 1.

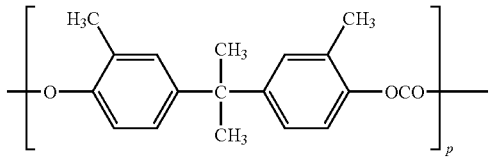

Example 15

Photosensitive Body Example 12

A photosensitive body was prepared in the same manner as in Example 4, except for using the following polycarbonate resin (polycarbonate resin No. 5) in place of the polycarbonate resin No. 1.

Example 16

Photosensitive Body Example 13

A photosensitive body was prepared in the same manner as in Example 4, except for using the following polycarbonate resin (polycarbonate resin No. 6) in place of the polycarbonate resin No. 1.

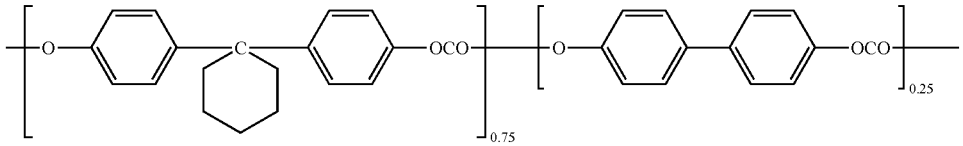

Example 17

Photosensitive Body Example 14

A photosensitive body was prepared in the same manner as in Example 6, except for using a mixture of the charge transport agent No. 3 and the p-terphenyl compound of the compound (4) (charge transport agent No. 4) in a mass ratio of 9:1 in place of the charge transport agent No. 2.

Example 18

Photosensitive Body Example 15

A photosensitive body was prepared in the same manner as in Example 17, except for using the polycarbonate resin No. 2 in place of the polycarbonate resin No. 1

Example 19

Photosensitive Body Example 16

1.0 part of the following bisazo pigment (charge generating agent No. 5, as a charge generating agent and 8.6 parts of a 5% cyclohexanone solution of a polyvinyl butyral resin (S-LEC BL-S, a product of Sekisui Chemical Co. Ltd.) were added to 83 parts of cyclohexanone, and grinding and dispersing treatment was conducted with ball mill for 48 hours. The dispersion obtained was applied to an aluminum surface of an aluminum-deposited PET film as a conductive support using a wire bar, and dried to form a charge generating layer having a thickness of 0.8 μm.

On the other hands 100 parts of the charge transport agent No. 1 as a charge generating agent was added to 962 parts of a 13.0% tetrahydrofuran solution of the polycarbonate resin No. 5, and the p-terphenyl compound was completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared.

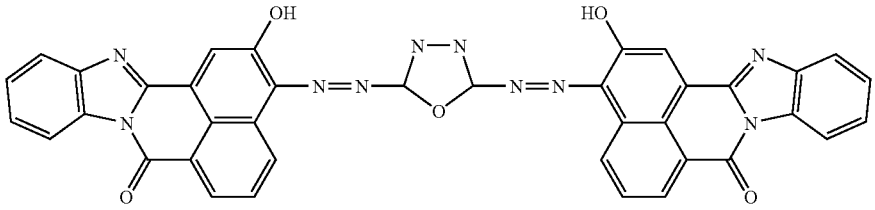

Example 20

Photosensitive Body Example 17

A photosensitive body was prepared in the same manner as in Example 19, except for using the following bisazo pigment (charge generating agent No. 6) in place of the charge generating No. 5.

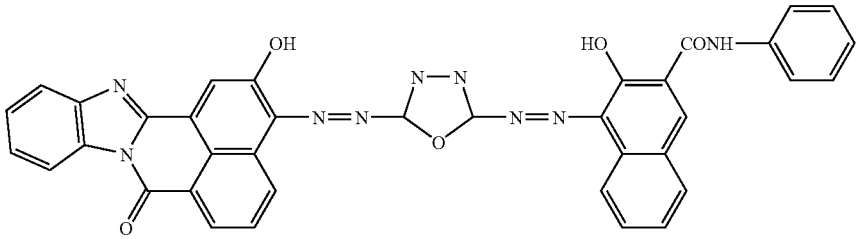

Example 21

Photosensitive Body Example 18

1.0 part of the following bisazo pigment as a charge generating agent (charge generating agent No. 7)

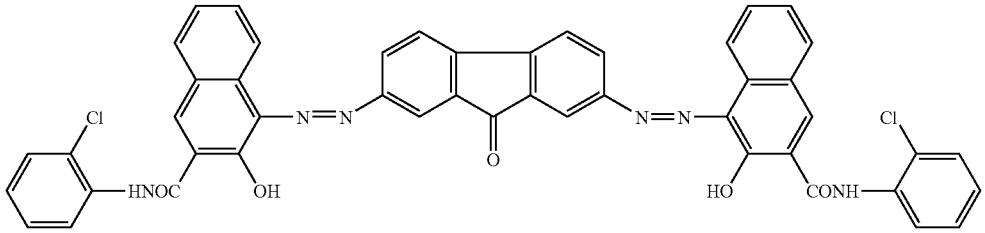

and 8.6 parts of a 5% tetrahydrofuran solution of a polyester resin (VYLON, a product of Toyobo Co., Ltd.) were added to 83 parts of tetrahydrofuran, and grinding and dispersing treatment was conducted with ball mill for 48 hours. The dispersion obtained was applied to an aluminum surface of an aluminum-deposited PET film as a conductive support using a wire bar, and dried to form a charge generating layer having a thickness of 0.8 μm.

On the other hand, 100 parts of the charge transport agent No. 3 as a charge generating agent was added to 962 parts of a 13.0% tetrahydrofuran solution of the polycarbonate resin No. 2, and the p-terphenyl compound was completely dissolved by applying ultrasonic wave. This solution was applied to the charge generating layer obtained above with a wire bar, and dried at 110° under atmospheric pressure for 30 minutes to form a charge transport layer having a thickness of 20 μm. Thus, a photosensitive body was prepared.

Comparative Example 1

A photosensitive body was prepared in the same manner as in Example 4, except for using the polycarbonate resin No. 3 in place of the polycarbonate resin No. 1.

Comparative Example 2

A photosensitive body was prepared in the same manner as in Example 10, except for using the polycarbonate resin No. 3 in place of the polycarbonate resin No. 1.

Comparative Example 3

A photosensitive body was prepared in the same manner as in Example 12, except for using the polycarbonate resin No. 3 in place of the polycarbonate resin No. 1.

Comparative Example 4

A photosensitive body was prepared in the same manner as in Example 17, except for using the polycarbonate resin No. 3 in place of the polycarbonate resin No. 1.

Comparative Example 5

A photosensitive body was prepared in the same manner as in Example 21, except for using the polycarbonate resin No. 3 in place of the polycarbonate resin No. 2.

Example 22

Electrophotographic characteristics of the photosensitive bodies prepared in Examples 4 to 18 and Comparative Examples 1 to 4 were evaluated using an electrostatic copying paper testing apparatus (trade name "EPA-8100"). First, the photosensitive body was subjected to corona discharge of −6.5 kV in a dark place, and charged potential at this time $V_0$ was measured. Next, the photosensitive body was exposed with 780 nm monochromatic light of 1.0 μw/cm$^2$ to obtain half light exposure $E_{1/2}$ (μJ/cm$^2$). This photosensitive body was abraded with 1,500 rotations using an abrasion wheel CS-10 by a rotary abrasion tester, a product of Toyo Seiki Co., Ltd. The results are shown in Table 1.

TABLE 1

| Example and Comparative Example | Charge generating agent No. | Charge transport agent No. | Polycarbonate resin No. | $V_o$ (−V) | $V_r$ (−V) | $E_{1/2}$ (μJ/cm$^2$) | Abrasion amount (mg) |
|---|---|---|---|---|---|---|---|
| Example 4 | 1 | 3 | 1 | 742 | 0 | 0.25 | 4 |
| Example 5 | 1 | 3 | 2 | 719 | 0 | 0.27 | 8 |
| Example 6 | 2 | 2 | 1 | 638 | 1 | 0.36 | 6 |
| Example 7 | 2 | 2 | 2 | 613 | 3 | 0.39 | 8 |
| Example 8 | 3 | 1 | 1 | 727 | 1 | 0.32 | 5 |
| Example 9 | 3 | 1 | 2 | 705 | 1 | 0.37 | 8 |
| Example 10 | 4 | 1 | 1 | 720 | 13 | 0.56 | 4 |

TABLE 1-continued

| Example and Comparative Example | Charge generating agent No. | Charge transport agent No. | Polycarbonate resin No. | $V_o$ (−V) | $V_r$ (−V) | $E_{1/2}$ (μJ/cm$^2$) | Abrasion amount (mg) |
|---|---|---|---|---|---|---|---|
| Example 11 | 4 | 1 | 2 | 707 | 15 | 0.59 | 8 |
| Example 12 | 2 | 1 | 1 | 640 | 1 | 0.32 | 4 |
| Example 13 | 2 | 1 | 2, 3 | 615 | 2 | 0.35 | 9 |
| Example 14 | 1 | 3 | 4 | 710 | 0 | 0.27 | 5 |
| Example 15 | 1 | 3 | 5 | 722 | 0 | 0.27 | 5 |
| Example 16 | 1 | 3 | 6 | 719 | 0 | 0.28 | 5 |
| Example 17 | 2 | 3, 4 | 1 | 626 | 2 | 0.32 | 5 |
| Example 18 | 2 | 3, 4 | 2 | 601 | 2 | 0.34 | 8 |
| Comparative Example 1 | 1 | 3 | 3 | 560 | 40 | 0.78 | 24 |
| Comparative Example 2 | 4 | 1 | 3 | 648 | 28 | 0.82 | 21 |
| Comparative Example 3 | 2 | 1 | 3 | 451 | 48 | 1.03 | 25 |
| Comparative Example 4 | 2 | 3, 4 | 3 | 454 | 51 | 0.98 | 24 |

Example 23

Electrophotographic characteristics of the photosensitive bodies prepared in Examples 19 to 21 and Comparative Example 5 were evaluated using an electrostatic copying paper testing apparatus (trade name "EPA-8100"). First, the photosensitive body was subjected to corona discharge of −6.0 kV in a dark place, and charged potential $V_0$ at this time was measured. Next, the photosensitive body was exposed with 1.0 Lux white light to obtain half light exposure $E_{1/2}$ (Lux·sec). This photosensitive body was abraded with 1,500 rotations using an abrasion wheel CS-10 by a rotary abrasion tester, a product of Toyo Seiki Co. Ltd. The results are shown in Table 2.

TABLE 2

| Example and Comparative Example | Charge generating agent No. | Charge transport agent No. | Polycarbonate resin No. | $V_o$ (−V) | $V_r$ (−V) | $E_{1/2}$ (Lux · sec) | Abrasion amount (mg) |
|---|---|---|---|---|---|---|---|
| Example 19 | 5 | 1 | 5 | 815 | 3 | 0.87 | 6 |
| Example 20 | 6 | 1 | 5 | 737 | 1 | 0.82 | 7 |
| Example 21 | 7 | 3 | 2 | 829 | 2 | 0.73 | 9 |
| Comparative Example 5 | 7 | 3 | 3 | 635 | 40 | 1.05 | 23 |

As described above, the present invention can provide an electrophotographic photosensitive body having improved electrophotographic characteristics such as sensitivity and residual potential and additionally excellent durability by combining a p-terphenyl compound having a specific structure as a charge transport agent and a polycarbonate resin having a specific structure as a binder resin.

While the present invention has been described in detail and with reference to specific embodiments thereof, it will be apparent to one skilled in the art that various modifications and changes can be made therein without departing from the spirit and scope thereof.

This application is based on Japanese Patent Application No. 2004-337169 filed Nov. 22, 2004 the disclosure of which is incorporated herein by reference in its entity.

INDUSTRIAL APPLICABILITY

According to the present invention, it is useful as an electrophotographic photosensitive body capable of satisfying electrophotographic characteristics and realizing high sensitivity and high durability.

The invention claimed is:

1. An electrophotographic photosensitive body comprising a conductive support having thereon a layer comprising at least one p-terphenyl compound selected from the following compounds (2)-(5)

(2)

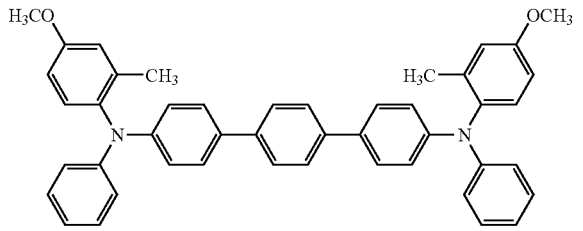

-continued (3)

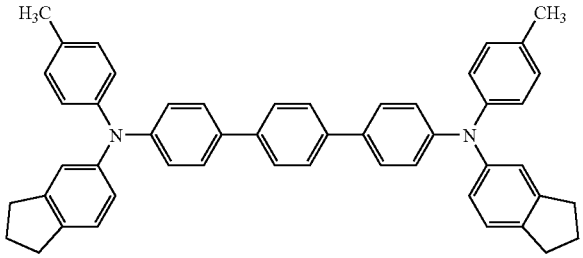

(4)

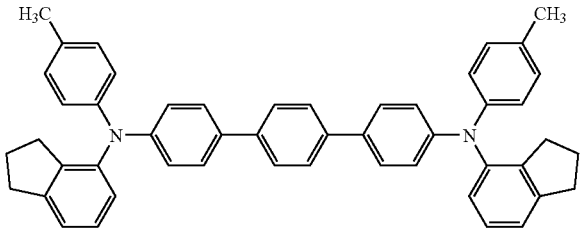

(5)

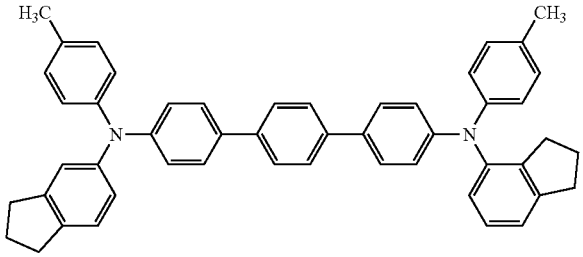

and at least one polycarbonate resin represented by the following general formula (I)

(I)

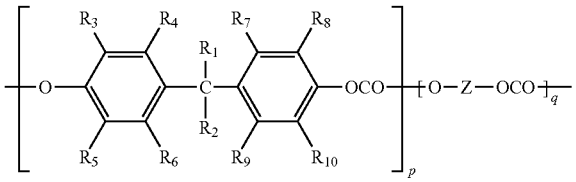

wherein $R_1$ and $R_2$ which may be the same or different represent a hydrogen atom, a substituted or unsubstituted alkyl group or a substituted or unsubstituted aryl group; $R_1$ and $R_2$ may be combined to form a ring; $R_3$, $R_4$, $R_5$, $R_6$, $R_7$, $R_8$, $R_9$ and $R_{10}$ which may be the same or different represent a hydrogen atom, a substituted or unsubstituted alkyl group, a substituted or unsubstituted aryl group or a halogen atom, p and q represent a molar compositional fraction (q includes zero); a ratio of p and q has a relationship satisfying the formula $0 \leqq q/p \leqq 2$; Z represents a substituted or unsubstituted alkylene group having from 1 to 5 carbon atoms, a substituted or unsubstituted 4,4'-biphenylene group or a divalent group represented by the following general formula (II)

(II)

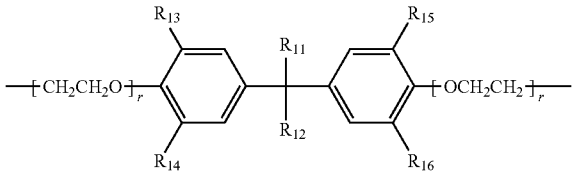

wherein $R_{11}$ and $R_{12}$ which may be the same or different represent a hydrogen atom, a substituted or unsubstituted alkyl group or a substituted or unsubstituted aryl group; $R_{11}$ and $R_{12}$ may be combined to form a ring; $R_{13}$, $R_{14}$, $R_{15}$ and $R_{16}$ which may be the same or different represent a hydrogen atom, a substituted or unsubstituted alkyl group, a substituted or unsubstituted aryl group or a halogen atom, and r is an integer of from 0 to 3, in a mass ratio of the p-terphenyl compound to the polycarbonate resin within the range of 2:8 to 7:3, with the proviso that when only one kind of the polycarbonate resin is used, the case where the polycarbonate resin represented by the general formula (I) has a structure that $R_1$ and $R_2$ are a methyl group, $R_3$, $R_4$, $R_5$, $R_6$, $R_7$, $R_8$, $R_9$ and $R_{10}$ are a hydrogen atom, and q is 0 is excluded.

2. The electrophotographic photosensitive body as claimed in claim 1, wherein the polycarbonate resin represented by the general formula (I) comprises at least one polycarbonate resin represented by any one of the following structural formulae (6) to (28), with the proviso that the case where the polycarbonate resin consists only of the polycarbonate resin represented by the structural formula (6) is excluded:

(6)

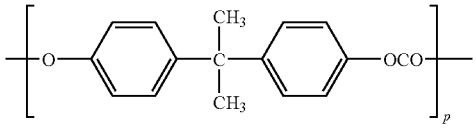

(7)

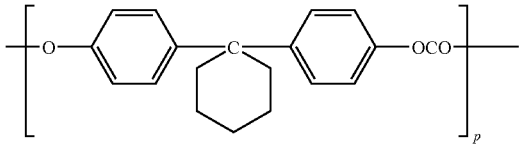

-continued
(8)
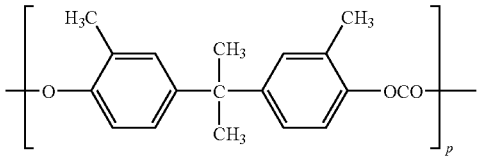
(9)
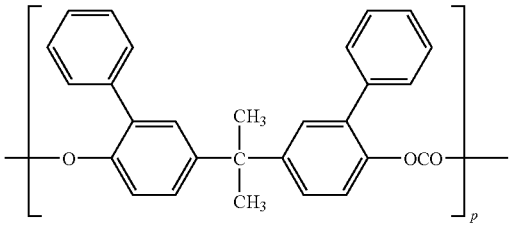
(10)
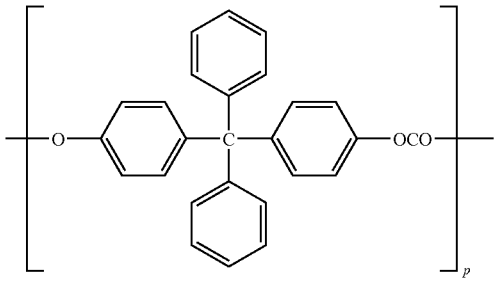
(11)
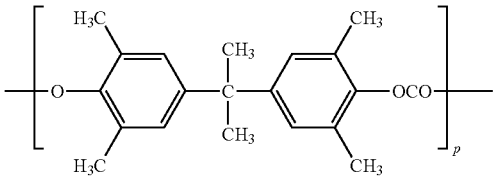
(12)
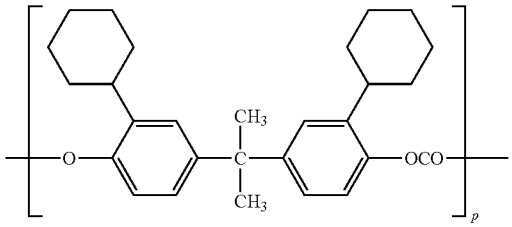
(13)
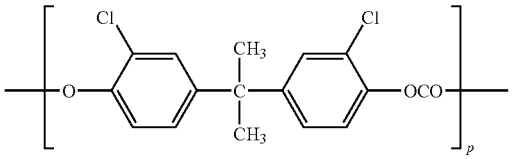
(14)
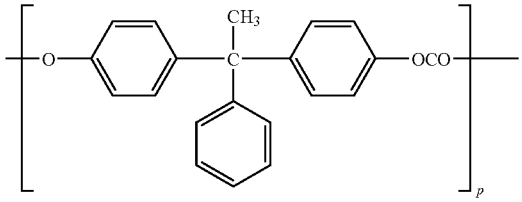
(15)
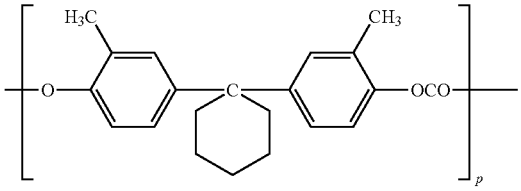
(16)
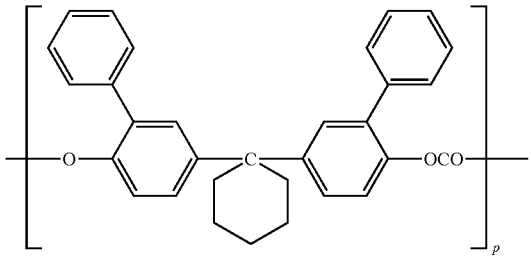
(17)
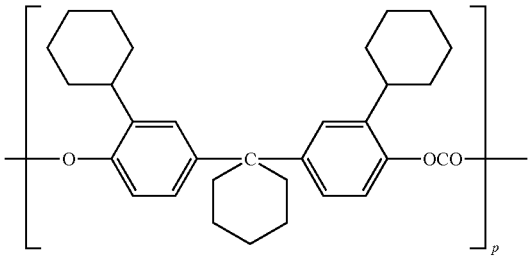
(18)
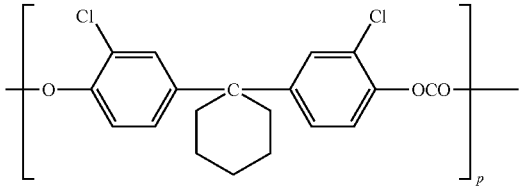
(19)
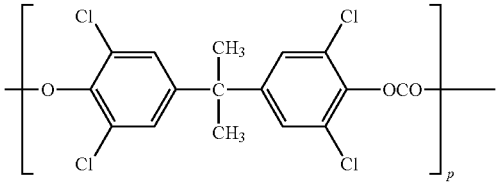

-continued
(20)
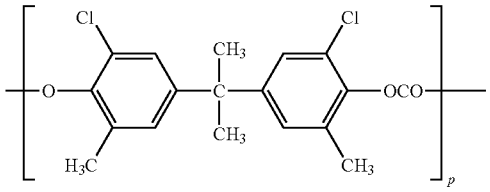
(21)
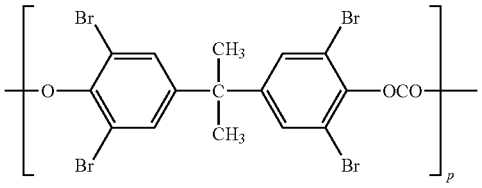
(22)
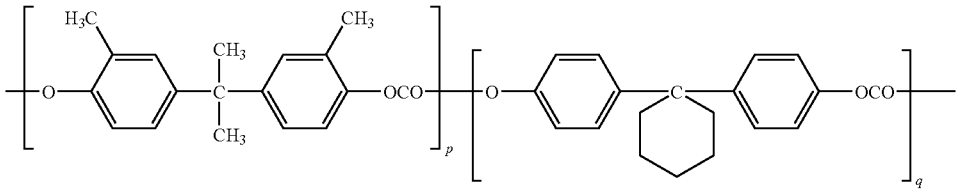
(23)
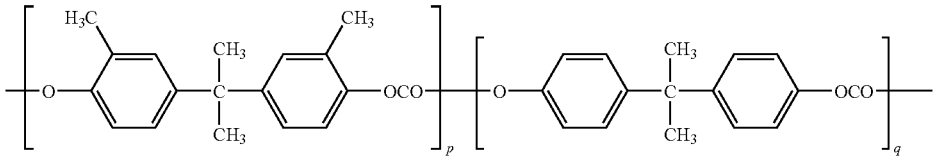
(24)
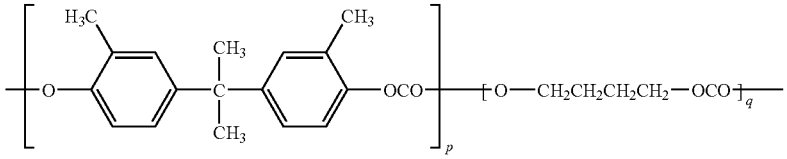
(25)
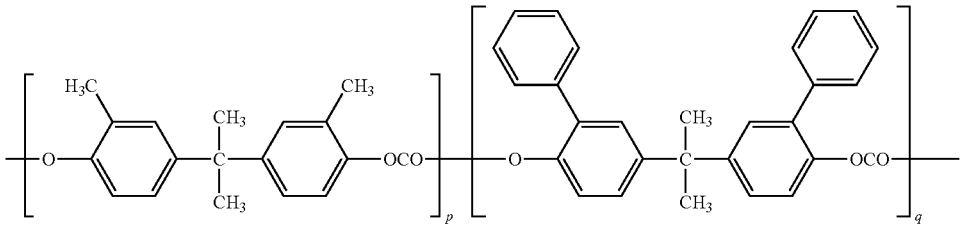
(26)
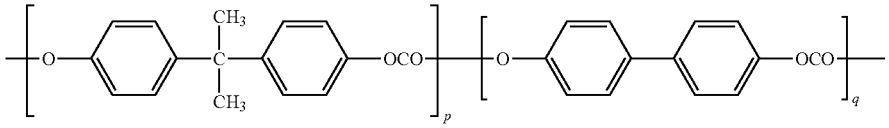
(27)
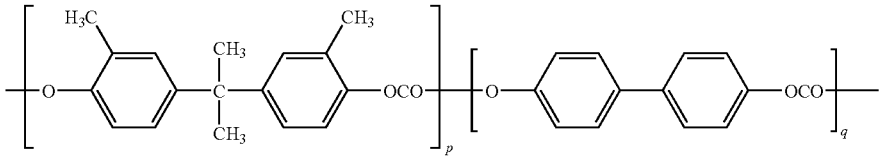
(28)
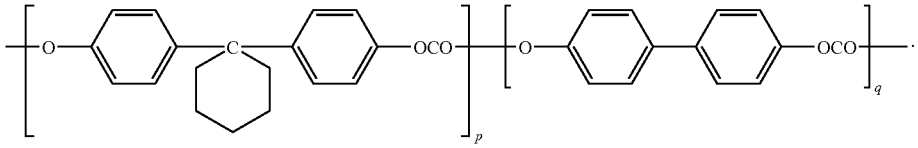

3. The electrophotographic photosensitive body as claimed in claim 1 or 2, wherein at least one p-terphenyl compound selected from the compounds (2) to (5) and at least one polycarbonate resin represented by the general formula (I) are contained in a mass ratio of the p-terphenyl compound to the polycarbonate resin within the range of 3:7 to 6:4.

4. The electrophotographic photosensitive body of claim 1, wherein the layer comprises the p-terphenyl compound of formula (3).

5. The electrophotographic photosensitive body of claim 1, wherein the layer comprises the p-terphenyl compound of formula (4).

6. The electrophotographic photosensitive body of claim 1, wherein the layer comprises the p-terphenyl compound of formula (5).

7. The electrophotographic photosensitive body of claim 2, wherein the polycarbonate resin represented by the general formula (I) comprises the polycarbonate resin represented by the structural formula (7).

8. The electrophotographic photosensitive body of claim 2, wherein the polycarbonate resin represented by the general formula (I) comprises the polycarbonate resin represented by the structural formula (8).

9. The electrophotographic photosensitive body of claim 2, wherein the polycarbonate resin represented by the general formula (I) comprises the polycarbonate resin represented by the structural formula (9).

10. The electrophotographic photosensitive body of claim 2, wherein the polycarbonate resin represented by the general formula (I) comprises the polycarbonate resin represented by the structural formula (10).

11. The electrophotographic photosensitive body of claim 2, wherein the polycarbonate resin represented by the general formula (I) comprises the polycarbonate resin represented by the structural formula (II).

12. The electrophotographic photosensitive body of claim 2, wherein the polycarbonate resin represented by the general formula (I) comprises the polycarbonate resin represented by the structural formula (12).

13. The electrophotographic photosensitive body of claim 2, wherein the polycarbonate resin represented by the general formula (I) comprises the polycarbonate resin represented by the structural formula (13).

14. The electrophotographic photosensitive body of claim 2, wherein the polycarbonate resin represented by the general formula (I) comprises the polycarbonate resin represented by the structural formula (14).

15. The electrophotographic photosensitive body of claim 2, wherein the polycarbonate resin represented by the general formula (I) comprises the polycarbonate resin represented by the structural formula (15).

16. The electrophotographic photosensitive body of claim 2, wherein the polycarbonate resin represented by the general formula (I) comprises the polycarbonate resin represented by the structural formula (16).

17. The electrophotographic photosensitive body of claim 2, wherein the polycarbonate resin represented by the general formula (I) comprises the polycarbonate resin represented by the structural formula (17).

18. The electrophotographic photosensitive body of claim 2, wherein the polycarbonate resin represented by the general formula (I) comprises the polycarbonate resin represented by the structural formula (18).

19. The electrophotographic photosensitive body of claim 2, wherein the polycarbonate resin represented by the general formula (I) comprises the polycarbonate resin represented by the structural formula (6).

* * * * *